US009564092B2

(12) United States Patent
Fujioka et al.

(10) Patent No.: US 9,564,092 B2
(45) Date of Patent: Feb. 7, 2017

(54) DRIVE DEVICE CHANGING REFRESH RATE OF DISPLAY PANEL AND DISPLAY DEVICE INCLUDING DRIVE DEVICE

(71) Applicant: Sharp Kabushiki Kaisha, Osaka-shi, Osaka (JP)

(72) Inventors: Akizumi Fujioka, Osaka (JP); Toshihiro Yanagi, Osaka (JP); Taketoshi Nakano, Osaka (JP)

(73) Assignee: Sharp Kabushiki Kaisha, Sakai (JP)

( * ) Notice: Subject to any disclaimer, the term of this patent is extended or adjusted under 35 U.S.C. 154(b) by 32 days.

(21) Appl. No.: 14/378,127

(22) PCT Filed: Feb. 13, 2013

(86) PCT No.: PCT/JP2013/053334
§ 371 (c)(1),
(2) Date: Aug. 12, 2014

(87) PCT Pub. No.: WO2013/125406
PCT Pub. Date: Aug. 29, 2013

(65) Prior Publication Data

US 2015/0002381 A1 Jan. 1, 2015

(30) Foreign Application Priority Data

Feb. 20, 2012 (JP) ..... 2012-034513

(51) Int. Cl.
*G09G 3/36* (2006.01)

(52) U.S. Cl.
CPC ..... *G09G 3/3648* (2013.01); *G09G 3/3614* (2013.01); *G09G 2310/08* (2013.01); *G09G 2320/0257* (2013.01); *G09G 2340/0435* (2013.01)

(58) Field of Classification Search
CPC ..... G09G 3/3614; G09G 2320/0257; G09G 2340/0435
USPC ..... 345/87
See application file for complete search history.

(56) References Cited

U.S. PATENT DOCUMENTS 7,123,246 B2 * 10/2006 Nakatani ..... G06F 3/1415 345/100
2002/0180673 A1 12/2002 Tsuda et al.
2010/0156886 A1 6/2010 Kawabe
2011/0109666 A1 5/2011 Owa et al.
2011/0157131 A1 * 6/2011 Miyake ..... G09G 3/3614 345/211

(Continued)

FOREIGN PATENT DOCUMENTS

JP 2001-312253 A 11/2001
JP 2004-151222 A 5/2004

(Continued)

OTHER PUBLICATIONS

Official Communication issued in International Patent Application No. PCT/JP2013/053334, mailed on May 14, 2013.

*Primary Examiner* — Kwang-Su Yang
(74) *Attorney, Agent, or Firm* — Keating & Bennett, LLP

(57) ABSTRACT

In a case where a display device (1) receives an instruction to change a refresh rate of a display panel (2), the display device (1) changes the refresh rate with a timing with which there is a balance between the length of time for which positive source signals are written and the length of time for which negative source signals are written.

9 Claims, 9 Drawing Sheets

(56) References Cited

U.S. PATENT DOCUMENTS

| | | | | |
|---|---|---|---|---|
| 2011/0267381 | A1 | 11/2011 | Yamazaki et al. | |
| 2011/0285697 | A1* | 11/2011 | Lee | G06F 1/324 345/211 |
| 2015/0154925 | A1* | 6/2015 | Koyama | G09G 3/3696 345/174 |

FOREIGN PATENT DOCUMENTS

| | | | |
|---|---|---|---|
| JP | 2010-145810 | A | 7/2010 |
| JP | 2011-102876 | A | 5/2011 |
| TW | 201142804 | A1 | 12/2011 |

* cited by examiner

FIG. 9

(a) Case1

| | | | | | | | | | | | | | | | | |
|---|---|---|---|---|---|---|---|---|---|---|---|---|---|---|---|---|
| FRAME | S | P | P | P | S | P | P | P | S | P | P | P | S | P | P | P |
| | + | + | + | + | - | - | - | - | + | + | + | + | - | - | - | - |
| COUNT | 1 | | | | 2 | | | | 3 | | | | 4 | | | |
| ODD/EVEN | E | | | | O | | | | E | | | | O | | | |
| | | | | | ↑ | | | | ↑ | | | | | | | |
| FrameRateControl | | | | | NG | | | | OK | | | | | | | |

(b) Case2

| | | | | | | | | | | | | | | | | | | | | | | | | |
|---|---|---|---|---|---|---|---|---|---|---|---|---|---|---|---|---|---|---|---|---|---|---|---|---|
| FRAME | S | S | S | P | P | P | S | S | S | P | P | P | S | S | S | P | P | P | S | S | S | P | P | P |
| | + | - | + | + | + | + | - | + | - | - | - | - | + | - | + | + | + | + | - | + | - | - | - | - |
| COUNT | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 |
| POLARITY BALANCE COUNT | +1 | ±0 | +1 | +2 | +3 | +4 | +3 | +4 | +3 | +2 | +1 | ±0 | +1 | ±0 | +1 | +2 | +3 | +4 | +3 | +4 | +3 | +2 | +1 | ±0 |
| | | | | | | | ↑ | | | | | ↑ | | | | | | | | | | | | ↑ |
| FrameRateControl | | | | | | | NG | | | | | OK | | | | | | | | | | | | OK |

(c) Case3

| | | | | | | | | | | | | | | | | | | | | | |
|---|---|---|---|---|---|---|---|---|---|---|---|---|---|---|---|---|---|---|---|---|---|
| FRAME | S | P | P | P | P | S | P | P | P | P | S | P | P | P | P | S | P | P | P | P | S |
| | + | - | + | - | + | - | + | - | + | - | + | - | + | - | + | - | + | - | + | - | + |
| COUNT | 1 | 2 | 3 | 4 | 5 | 6 | 7 | 8 | 9 | 10 | 11 | 12 | 13 | 14 | 15 | 16 | 17 | 18 | 19 | 20 | 21 |
| POLARITY BALANCE COUNT | +1 | +2 | +3 | +4 | +5 | +4 | +3 | ±2 | ±1 | ±0 | +1 | +2 | +3 | +4 | +5 | +4 | +3 | ±2 | ±1 | ±0 | +1 |
| | | | | | ↑ | | | | | ↑ | | | | | ↑ | | | | | ↑ | |
| FrameRateControl | | | | | NG | | | | | OK | | | | | NG | | | | | OK | |

(d) Case4

| | | | | | | | | | | | | | | | | | | | | | | | | | | | |
|---|---|---|---|---|---|---|---|---|---|---|---|---|---|---|---|---|---|---|---|---|---|---|---|---|---|---|---|
| FRAME | S | S | S | P | P | P | P | S | S | S | P | P | P | P | S | S | S | P | P | P | P | S | S | S | P | P | P |
| | + | - | + | - | + | - | + | - | + | - | + | - | + | - | + | - | + | - | + | - | + | - | + | - | - | - | - |
| COUNT | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 |
| POLARITY BALANCE COUNT | +1 | ±0 | +1 | +2 | +3 | +4 | +5 | +4 | +5 | +4 | +3 | ±2 | ±1 | ±0 | +1 | ±0 | +1 | +2 | +3 | +4 | +5 | +4 | +5 | +4 | +3 | ±2 | ±1 |
| | | | | | | | ↑ | | | | | | | ↑ | | | | | | | ↑ | | | | | | |
| FrameRateControl | | | | | | | NG | | | | | | | OK | | | | | | | NG | | | | | | |

DRIVE DEVICE CHANGING REFRESH RATE OF DISPLAY PANEL AND DISPLAY DEVICE INCLUDING DRIVE DEVICE

TECHNICAL FIELD

The present invention relates to a drive device and a display device.

BACKGROUND ART

In recent years, thin, light, and low-power-consumption display devices such as liquid crystal display devices have been widely used. It is noteworthy that such display devices have been mounted, for example, on electronic book devices, smartphones, mobile phones, tablet devices, PDAs (portable information devices), laptop personal computers, portable gaming devices, car navigation devices, and the like. It is expected that in the future, development and prevalence of electronic paper, which is an even thinner display device, will be rapidly advanced. Under such circumstances, it is now a common challenge to reduce power consumption of display devices and to improve display quality of the display devices.

Therefore, conventionally, there have been various proposed technologies intended to overcome the challenge of the display devices.

For example, there is a technology used that increases a refresh rate in order to improve display quality. For example, the refresh rate is increased from 60 Hz (i.e. 60 fps) to 120 Hz (i.e. 120 fps) while a video image is being displayed. This allows a smoother motion to be delivered and a reduction in the occurrence of a display malfunction such as flickering.

However, since the number of times a display panel is driven increases along with the increase in the refresh rate, electric power consumption also becomes increased. Therefore, the use is made of a technology that, on the contrary, reduces a refresh rate in a case where emphasis is placed on a reduction in electric power consumption.

As a specific example, Patent Literature 1 discloses a technology in which (i) image quality is improved by actively increasing a refresh rate in a case where false contours are likely to occur or false contours are noticeable on a displayed image and (ii) power consumption is reduced by actively lowering the refresh rate in a case where false contours are unlikely to occur or false contours are unnoticeable on a displayed image.

CITATION LIST

Patent Literature

Patent Literature 1

Japanese Patent Application Publication, Tokukai, No. 2010-145810 (Publication Date: Jul. 1, 2010)

SUMMARY OF INVENTION

Technical Problem (Example of how Conventional Display Device Changes Refresh Rate)

An example of how a conventional display device changes a refresh rate will be described below with reference to FIG. 8. FIG. 8 is a view schematically showing the example of how the conventional display device changes a refresh rate.

FIG. 8 shows which of source signals is written into a pixel in the conventional display device during every frame, the source signals being (i) a source signal having a voltage higher than a reference voltage (such a source signal is hereinafter referred to as "positive data") and (ii) a source signal having a voltage lower than the reference voltage (such a source signal is hereinafter referred to as "negative data"). In FIG. 8, (i) frames indicated by "+" are each a frame during which positive data is written into the pixel and (ii) frames indicated by "−" are each a frame during which negative data is written into the pixel. In the example shown in FIG. 8, in particular, the conventional display device employs a "per-frame" cycle as a time-based cycle of polarity inversion. Therefore, in the example shown in FIG. 8, a polarity of the pixel alternates with every frame as in a pattern of "+, −, +, − . . . "

As shown in FIG. 8, the conventional display device is configured such that the refresh rate is changed with timings with which an instruction to change the refresh rate is received.

For example, the conventional display device receives, after a third frame ends (timing t1), an instruction to change the refresh rate from 30 Hz to 60 Hz. In response, the conventional display device immediately changes the refresh rate to 60 Hz. This causes a refresh rate during a fourth frame and subsequent frames to be 60 Hz.

Note that, at a point in time where the third frame ends, the number of times positive source signals have been written is 2 whereas the number of times negative source signals have been written is 1. That is, at the point in time where the third frame ends, there is a 2/60-second difference between (i) the length of time for which the polarity of the pixel has been positive and (ii) the length of time for which the polarity of the pixel has been negative. After the third frame ends, the refresh rate is changed. This prevents such a time difference from being offset, according to the conventional display device. For example, even in a case where a negative source signal is written during the fourth frame, a period for which to write the negative source signal is merely a 1/60 second. This still leaves a 1/60-second time difference in existence. Such a time difference (i.e. a one-sided state of the polarity) results in the occurrence of a display malfunction such as image sticking.

The present invention has been made in view of the problem, and it is an object of the present invention to provide a display device in which a display malfunction as a result of a change in refresh rate is unlikely to occur.

Solution to Problem

In order to attain the object, a drive device in accordance with an embodiment of the present invention is a drive device for driving a display panel, said display panel including: pixels, said drive device including: refresh rate changing means for changing, in a case where (i) positive source signals and negative source signals are being written into at least one pixel of the display panel such that the positive source signals and the negative source signals are alternated with every frame or with every given number of frames and (ii) an instruction to change a refresh rate of the display panel is received, the refresh rate with a timing with which there is a balance between a length of time for which the positive source signals are written into the at least one pixel and a length of time for which the negative source signals are written into the at least one pixel.

A display device in accordance with an embodiment of the present invention includes: a display panel including pixels; and the drive device.

Advantageous Effects of Invention

According to an embodiment of the present invention, in a case where a refresh rate of a display panel is changed, there is a match, in each of pixels in the display panel, between the length of time for which positive data is written and the length of time for which negative data is written. In other words, each of the pixels is prevented from being one-sided in polarity. This makes it possible to provide a display device in which a display malfunction such as image sticking as a result of a change in refresh rate is unlikely to occur.

BRIEF DESCRIPTION OF DRAWINGS

FIG. 9 is a view illustrating specific examples of determining methods which the display device of the embodiment employs according to various conditions.

DESCRIPTION OF EMBODIMENTS

The following description will discuss an embodiment of the present invention with reference to the drawings.

(Configuration of Display Device)

Figure 1:
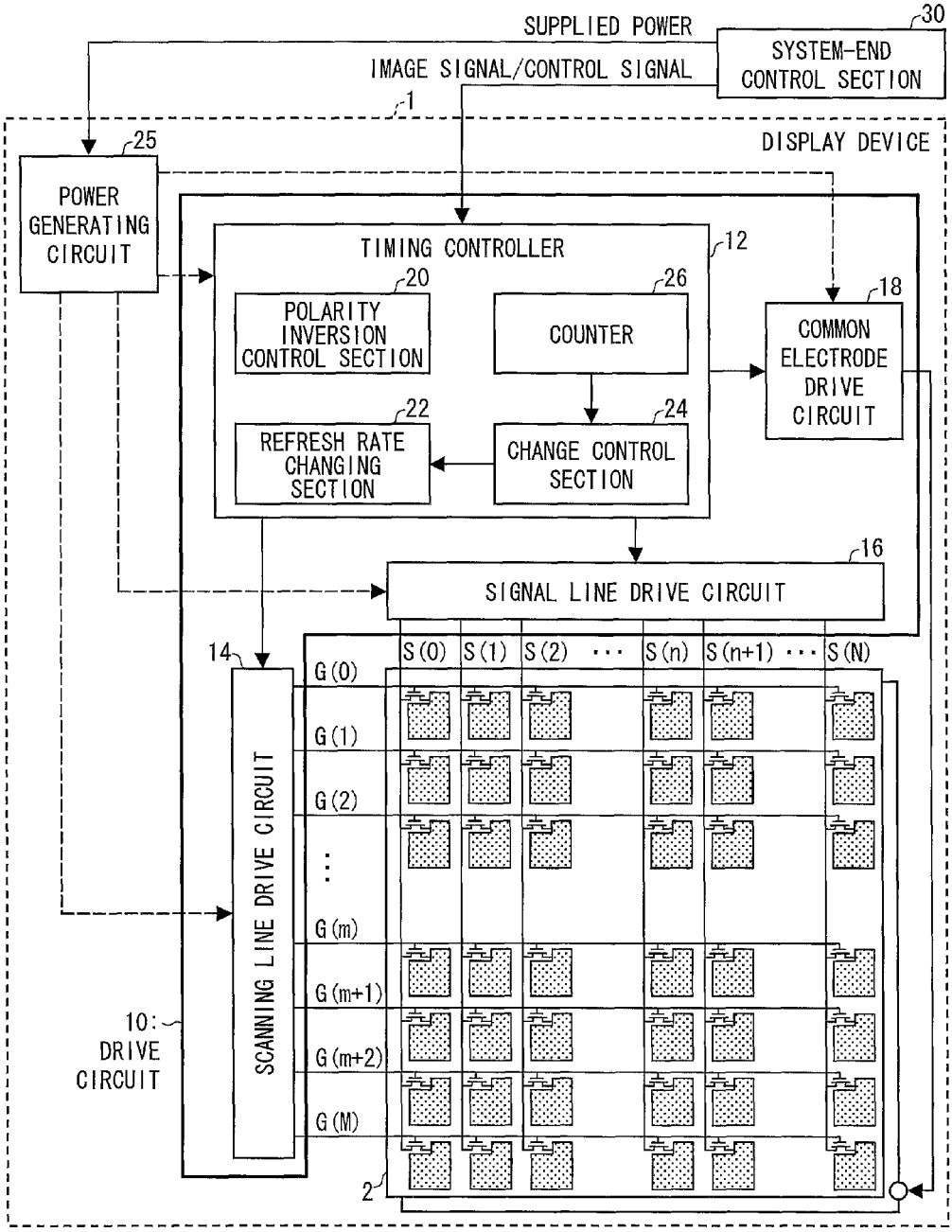
FIG. 1 is a view illustrating an overall configuration of a display device in accordance with an embodiment.

An example of a configuration of a display device 1 in accordance with the embodiment will be first described with reference to FIG. 1. FIG. 1 is a view illustrating an overall configuration of the display device 1 in accordance with Embodiment 1.

As illustrated in FIG. 1, the display device 1 includes a display panel 2, a display drive circuit 10, and a power generating circuit 28. The display drive circuit 10 includes a timing controller 12, a scanning line drive circuit 14, a signal line drive circuit 16, and a common electrode drive circuit 18.

The display device 1, as a display device for displaying various types of information, is to be mounted on electronic book devices, smartphones, mobile phones, PDAs, laptop personal computers, portable gaming devices, car navigation devices, and the like. In the present embodiment, an active matrix liquid crystal display device is employed as the display device 1. Therefore, the display panel 2 of the present embodiment is an active matrix liquid crystal display panel, and the other components mentioned above are configured to drive such a liquid crystal display panel.

(Display Panel)

The display panel 2 includes pixels, gate signal lines G, and source signal lines S.

The pixels are arranged in what is known as a grid pattern made up of pixel columns and pixel rows.

The gate signal lines G are arranged side by side in a pixel-column direction (i.e. a direction along the pixel columns). Each of the gate signal lines G is electrically connected to pixels of a corresponding one of the pixel rows.

The source signal lines S are (i) arranged side by side in a pixel-row direction (i.e. a direction along the pixel rows) and (ii) each orthogonal to each of the gate signal lines G. Each of the source signal lines S is electrically connected to pixels of a corresponding one of the pixel columns.

In the example shown in FIG. 1, the display panel 2 includes the pixels of N (N is an integer) columns by M (M is an integer) rows, and, accordingly, includes N source signal lines S and M gate signal lines G.

(Scanning Line Drive Circuit)

The scanning line drive circuit 14 selects and scans the gate signal lines G one after another. Specifically, the scanning line drive circuit 14 (i) selects the gate signal lines G one after another and (ii) supplies, to a selected gate signal line G, an on-voltage for turning on switching elements (TFTs) provided on respective pixels of the selected gate signal line G.

(Signal Line Drive Circuit)

While any given gate signal line G is being selected, the signal line drive circuit 16 supplies source signals (that correspond to image data) to pixels on the selected gate signal line G via source signal lines S that correspond to the respective pixels. Specifically, the signal line drive circuit 16 (i) calculates, based on an inputted video signal, a voltage to be supplied to the pixels of the selected gate signal line G and then (ii) supplies the voltage to the source signal lines S via a source output amplifier. This causes a source signal to be supplied to and written into each of the pixels on the selected gate signal line G.

(Common Electrode Drive Circuit)

The common electrode drive circuit 18 supplies, to a common electrode provided for the pixels, a predetermined common voltage for driving the common electrode.

(Timing Controller)

The timing controller 12 receives a video signal and a control signal from an external source (a system-end control section 30 in the example of FIG. 1). The video signal herein includes a clock signal, a sync signal, and an image data signal. The control signal may include an instruction to change a refresh rate. Then, in accordance with the video signal and the control signal, the timing controller 12 supplies, to the drive circuits, various control signals for causing the drive circuits to operate in synchronization (see solid arrows shown in FIG. 1).

For example, the timing controller 12 supplies, to the scanning line drive circuit 14, (i) a gate start pulse signal, (ii) a gate clock signal GCK, and (iii) a gate output control signal GOE. When receiving the gate start pulse signal, the scanning line drive circuit 14 starts scanning the gate signal lines G. Then, in accordance with the gate clock signal GCK and the gate output control signal GOE, the scanning line drive circuit 14 supplies on-voltages to the respective gate signal lines G one after another.

The timing controller 12 supplies, to the signal line drive circuit 16, (i) a source start pulse signal, (ii) a source latch strobe signal, and (iii) a source clock signal. In response to the source start pulse signal thus received, the signal line drive circuit 16 stores image data of each pixel in a register in accordance with the source clock signal. Then, in response to the source latch strobe signal thus received, the signal line drive circuit 16 supplies, to each of the source signal lines S, a source signal corresponding to the image data.

(Power Generating Circuit)

The power generating circuit 28 (i) receives electric power supplied from an external source (the system-end control section 30 in the example of FIG. 1) and (ii) generates, from the electric power, respective voltages required for driving the scanning line drive circuit 14, the signal line drive circuit 16, and the common electrode drive circuit 18. Then, as indicated by dotted arrows shown in FIG. 1, the power generating circuit 28 supplies the respective voltages to the scanning line drive circuit 14, the signal line drive circuit 16, and the common electrode drive circuit 18.

(Additional Functions of Display Device 1)

Additional functions of the display device 1 will be described below. The display device 1 further includes a polarity inversion control section 20, a refresh rate changing section 22, a change control section 24, and a counter 26. In the example shown in FIG. 1, the functions described above are realized by the timing controller 12. However, the functions described above can be realized by circuits or the like instead of the timing controller 12.

(Polarity Inversion Control Section 20)

The polarity inversion control section 20 controls a polarity inversion mode in which the signal line drive circuit 16 writes source signals into the pixels.

Examples of the polarity inversion mode controlled by the polarity inversion control section 20 encompass (i) a polarity inversion mode that defines a time-based cycle of polarity inversion of source signals and (ii) a polarity inversion mode that defines a space-based cycle of polarity inversion of source signals.

The "time-based cycle" defines the number of frames with which polarities of the pixels of the display panel 2 are alternated. On the other hand, the "space-based cycle" defines the number of pixels in the pixel-column direction and in the pixel-row direction with which the pixels of the display panel 2 are alternated.

The signal line drive circuit 16 writes source signal into the pixels in a polarity inversion mode (the time-based cycle and/or the space-based cycle) controlled by the polarity inversion control section 20.

(Refresh Rate Changing Section 22)

The refresh rate changing section 22 changes a refresh rate of the display panel 2. The refresh rate determines the frequency with which display on the display panel 2 is updated. For example, in a case where the refresh rate is "60 Hz", the display is updated 60 times per second (i.e. 60 frames is displayed per second). In a case where the refresh rate is "120 Hz", the display is updated 120 times per second (i.e. 120 frames is displayed per second).

In general, a higher refresh rate of a display panel, while resulting in superior display quality, leads to greater electric power consumption because a display-update frequency increases. Therefore, a refresh rate is set high in a case where display quality is prioritized such as a case where a video image is displayed or where a high-definition mode is selected. On the other hand, a refresh rate may be set low in a case where low power consumption is prioritized such as a case where a still image is displayed or where a power-saving mode is selected.

According to the present embodiment, (i) the display device 1 receives, from an external source (e.g. system control section 30), an instruction to change a refresh rate and (ii) the refresh rate changing section 22 changes the refresh rate in accordance with the instruction. Alternatively, it may be the timing controller 12 that gives an instruction to change the refresh rate. In such a case, the refresh rate changing section 22 changes the refresh rate in accordance with what is determined by the timing controller 12. Note that in a case where an instruction to change the refresh rate is given by the timing controller 12, such a case is still included in the definition of "a case where an instruction to change a refresh rate is received."

In a case where the refresh rate of the display panel 2 is changed, each component of the display device 1 drives, in accordance with various control signals supplied from the timing controller 12, the display panel 2 such that the display panel 2 display an image at a changed refresh rate.

(Change Control Section 24)

The change control section 24 controls timings with which the refresh rate changing section 22 changes the refresh rate.

As has already been described, positive data and negative data are written into each of the pixels of the display panel 2 such that the positive data and the negative data are alternated with every frame or every given number of frames.

In a case where the display device 1 receives an instruction to change the refresh rate, the change control section 24 controls the refresh rate changing section 22 to change the refresh rate at a timing with which there is a match between (i) the length of time for which positive data is written into each pixel at a pre-change refresh rate and (ii) the length of time for which negative data is written into each pixel at the pre-change refresh rate.

As a result, the length of time for which the positive data is written into each pixel matches the length of time for which the negative data is written into each pixel. This realizes prevention of a malfunction such as image sticking on each pixel.

(Counter 26)

The counter 26 counts the number of times positive data and negative data are written. According to the present embodiment, the use is made of, as a counter 26, an odd/even counter for producing an output indicative of whether the sum of the number of times the positive data is written and the number of times the negative data is written is an odd number or an even number. In accordance with the output supplied from the counter 26, the change control section 24 determines a timing with which to change the refresh rate.

For example, in a case where the sum is an even number, the counter 26 outputs a High-level signal indicating that the sum is an even number. In a case where the sum is an odd number, the counter 26 outputs a Low-level signal indicating that the sum is an odd number. Note, however, that a signal to be outputted from the counter 26 is not limited to such signals, but can be any signal, provided that the signal at least allows the change control section 24 to determine whether the sum is an even number of an odd number.

(Odd/Even Counter)

In a case where an odd/even counter is used as a counter 26 as in the present embodiment, the counter 26 can carry out the counting in synchronization with a time-based cycle of polarity inversion (i.e. carry out the counting each time the polarity is inverted in a time-based manner). For example, in a case where a "one-frame" cycle is employed as a time-based cycle of the polarity inversion, the counter 26 carries out the counting with every frame and outputs the signal. In a case where a "two-frame" cycle is employed as a time-based cycle of the polarity inversion, the counter 26 carries out the counting with every two frames and outputs the signal. This, even in a case where the time-based cycle of the polarity inversion is not a "one-frame" cycle, allows the change control section 24 to determine, by use of the output signal (indicating an even or odd number) from the counter 26, whether or not there is a match between (i) the number of times the positive data is written and (ii) the number of times the negative data is written.

(Other Counters)

Note that the use can also be made of, as a counter 26, a counter that individually counts (i) the number of frames during which positive data is written and (ii) the number of frames during which negative data is written. In a case where (a) such a counter 26 is used and (b) the respective numbers of frames are, with a given timing, equal or different by a number smaller than a predetermined number, the change control section 24 preferably determines a refresh rate is to be changed at the timing. Additionally, in such a case, the counter 26 preferably counts not only the number of frames designated as scanning periods but also the number of frames designated as pausing periods. This is because data written into the pixels is retained during the pausing periods as well, and it is therefore appropriate to also include the pausing periods as periods during which the data is written.

(Specific Examples of Polarity Inversion Mode)

Figure 2:
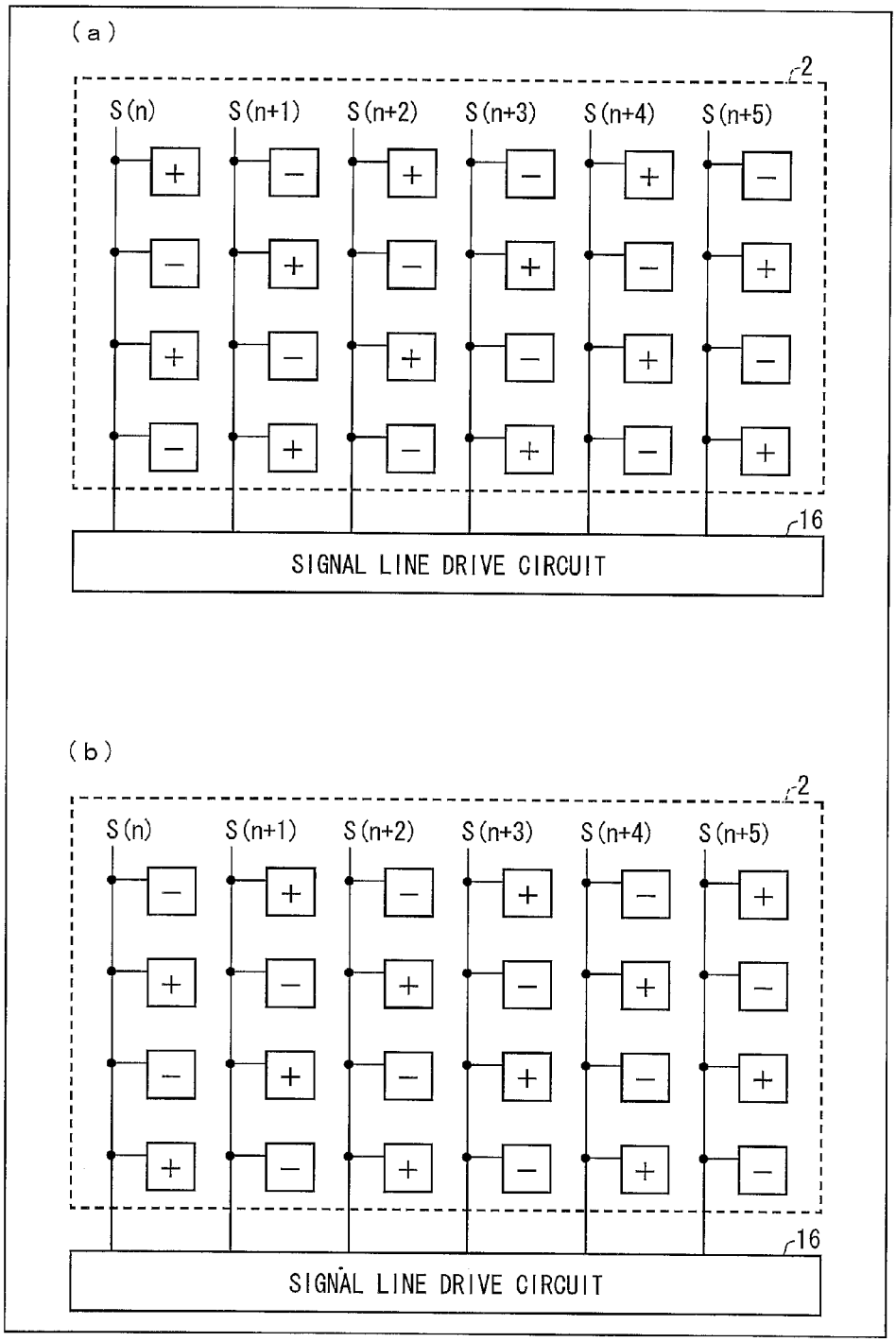
FIG. 2 is a view illustrating a display panel in a state in which a source signal is written in a "dot inversion" polarity inversion mode.
Figure 3:
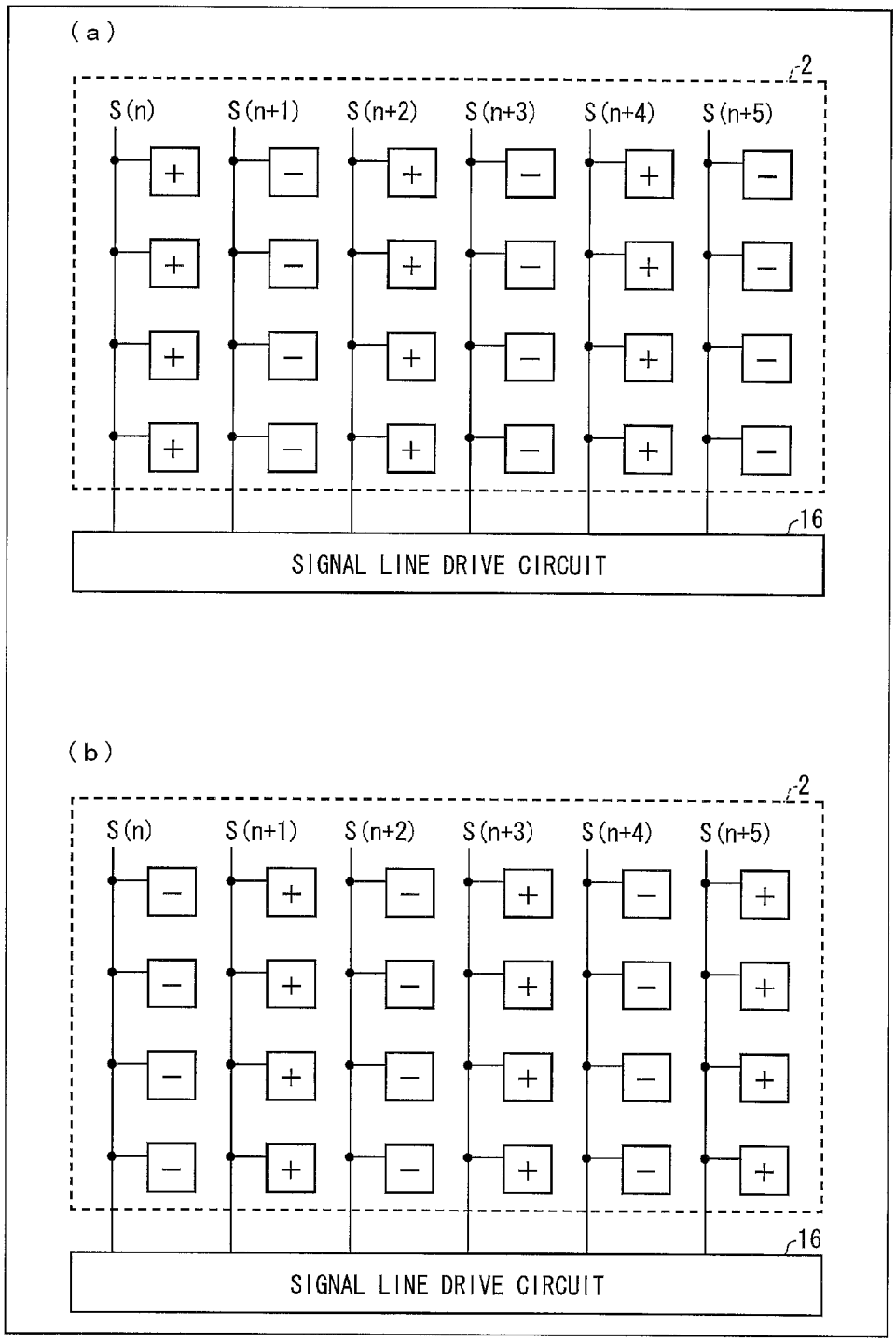
FIG. 3 is a view illustrating a display panel in a state in which a source signal is written in a "source inversion" polarity inversion mode.

The following description will discuss, in detail, polarity inversion modes with reference to FIGS. 2 and 3. The description will discuss, as polarity inversion modes, a "dot inversion" mode and a "source inversion" mode by employing pixels of 6 pixel columns by 4 pixel rows which pixels are part of the pixels provided on the display panel 2.

FIG. 2 is a view illustrating the display panel 2 on which source signals are written in the "dot inversion" mode. In contrast, FIG. 3 is a view illustrating the display panel 2 on which source signals are written in the "source inversion" mode.

In FIGS. 2 and 3, pixels indicated by "+" are each a pixel into which positive data is being written whereas pixels indicated by "−" are each a pixel into which negative data is being written.

Between (a) of FIG. 2 and (b) of FIG. 2 and between (a) of FIG. 3 and (b) of FIG. 3, polarities of pixels into which source signals are written are inverted.

(Space-Based Cycle of Polarity Inversion)

As illustrated in FIG. 2, the "dot inversion" mode causes pixels in each pixel column to be arranged such that, in spatial directions (in the pixel-column and pixel-row directions) of the display panel, polarities of source signals alternates with every pixel as in a pattern of "+, −, +, − . . . " or "−, +, −, + . . . "

As illustrated in FIG. 3, the "source inversion" mode causes (i) pixels in each pixel column to be arranged such that polarities of source signals written into the pixels are all equal as in a pattern of "+, +, +, + . . . " or "−, −, −, − . . . " and (ii) pixels in each pixel row to be arranged such that polarities of source signals written into the pixels are alternated with every pixel as in a pattern of "+, −, +, − . . . " or "−, +, −, + . . . "

(Time-Based Cycle of Polarity Inversion)

As illustrated in FIG. 2, in a case where (i) a "dot inversion" cycle is employed as a space-based cycle of the polarity inversion and (ii) a "one-frame" cycle is employed as a time-based cycle of the polarity inversion, the display panel 2 is then in a state in which the polarity of each pixel is alternated with every frame as in a pattern of "(a) of FIG. 2, (b) of FIG. 2, (a) of FIG. 2, (b) of FIG. 2 . . . " In a case where in a case where (i) a "dot inversion" cycle is employed as a space-based cycle of the polarity inversion and (ii) a "two-frame" cycle is employed as a time-based cycle of the polarity inversion, the display panel 2 is then in a state in which the polarity of each pixel is alternated with every two frames as in a pattern of "(a) of FIG. 2, (a) of FIG. 2, (b) of FIG. 2, (b) of FIG. 2 . . . "

Likewise, in a case where (i) a "source inversion" cycle is employed as a space-based cycle of the polarity inversion and (ii) a "one-frame" cycle is employed as a time-based cycle of the polarity inversion, the display panel 2 is then in a state in which the polarity of each pixel is alternated with every frame as in a pattern of "(a) of FIG. 3, (b) of FIG. 3, (a) of FIG. 3, (b) of FIG. 3 . . . " In a case where (i) a "source inversion" cycle is employed as a space-based cycle of the polarity inversion and (ii) a "two-frame" cycle is employed as a time-based cycle of the polarity inversion, the display panel 2 is then in a state in which the polarity of each pixel is alternated with every two frames as in a pattern of "(a) of FIG. 3, (a) of FIG. 3, (b) of FIG. 3, (b) of FIG. 3 . . . "

(Example of Changing Refresh Rate)

Figure 4:
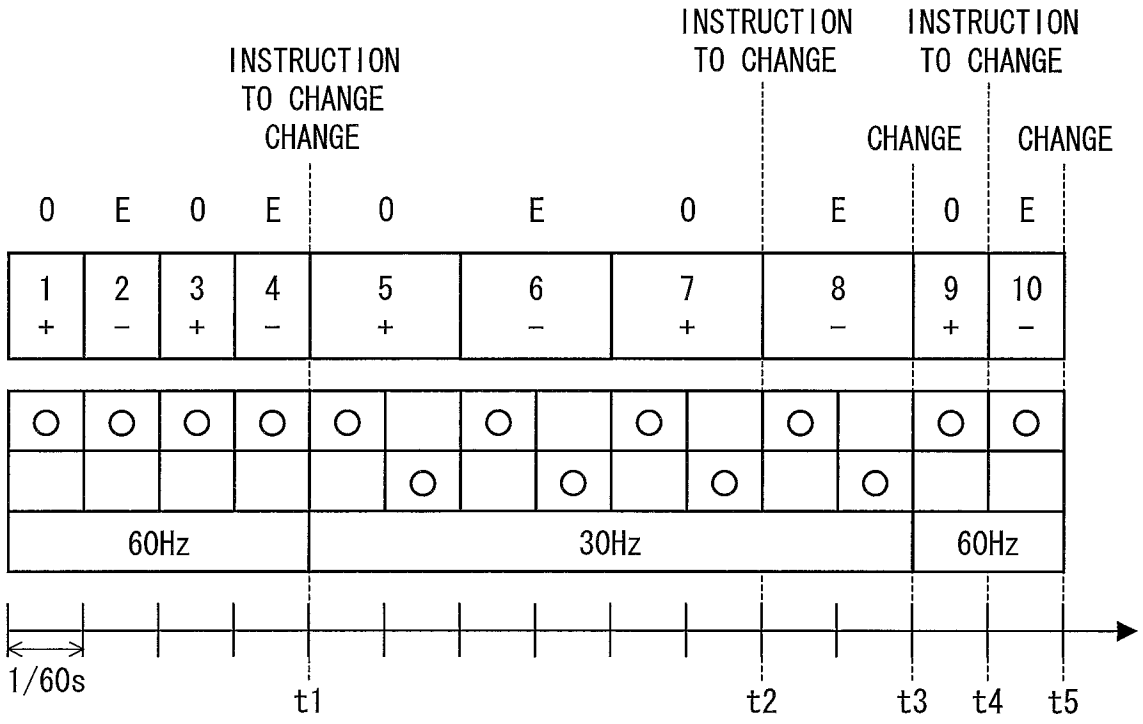
FIG. 4 is a view schematically illustrating an example in which the display device of the embodiment changes a refresh rate.

An example of how the display device 1 of the embodiment changes a refresh rate will be described next with reference to FIG. 4. FIG. 4 is a view schematically showing the example of how the display device 1 changes the refresh rate.

FIG. 4 shows which of positive data and negative data is written into a given pixel of the display device 1 during each frame. In FIG. 4, (i) frames indicated by "+" each mean a frame during which the positive data is written into the pixel and (ii) frames indicated by "−" each mean a frame during which the negative data is written into the pixel. In the example shown in FIG. 4, in particular, the display device 1 employs a "one-frame" cycle as a time-based cycle of the polarity inversion. Therefore, in the example shown in FIG. 4, a polarity of the pixel is alternated with every frame as in a pattern of "+, −, +, − . . . "

As shown in FIG. 4, in a case where, with a timing with which the display device 1 receives an instruction to change the refresh rate, there is a match between the number of times the positive data has been written and the number of times the negative data has been written at a pre-change refresh rate, the change control section 24 controls the refresh rate changing section 22 to change the refresh rate with the timing.

On the other hand, in a case where, with a timing with which the display device 1 receives an instruction to change the refresh rate, there is a difference between the number of times the positive data has been written and the number of times the negative data has been written at a pre-change refresh rate, the change control section 24 controls the refresh rate changing section 22 to change the refresh rate with a timing with which there will be a match between the number of times the positive data has been written and the number of times the negative data has been written at a pre-change refresh rate.

In the example shown in FIG. 4, for example, the display device 1 receives, after a fourth frame ends (with a timing t1), an instruction to change the refresh rate to 30 Hz. At the timing t1, the positive data and the negative data have each been written twice at a pre-change refresh rate (60 Hz). Therefore, an output from the counter 26 indicates "even number."

Based on the output, the change control section 24 determines that there is a match between the number of times the positive data has been written and the number of times the negative data has been written. Therefore, the change control section 24 controls the refresh rate changing section 22 to change the refresh rate with this timing (timing t1). Accordingly, the refresh rate changing section 22 changes a refresh rate during a fifth frame and subsequent frames (after the timing t1) to 30 Hz.

Subsequently, the display device 1 receives, after a seventh frame (with a timing t2), an instruction to change the refresh rate to 60 Hz. At the timing t2, the positive data has been written twice and the negative data has been written once at the pre-change refresh rate (30 Hz). Therefore, an output from the counter 26 indicates "odd number."

Based on the output, the change control section 24 determines that there is a difference between the number of times the positive data has been written and the number of times the negative data has been written. Therefore, the change control section 24 controls the refresh rate changing section 22 to delay, by as long as one frame, the timing with which to change the refresh rate so that the refresh rate will be changed with a timing (timing t3) with which there is a match between the number of times the positive data has been written and the number of times the negative data has been written. Accordingly, the refresh rate changing section changes a refresh rate during a ninth frame and subsequent frames (after the timing t3) to 60 Hz.

Then, the display device 1 receives, after the ninth frame ends (with a timing t4), an instruction to change the refresh rate to 30 Hz. At the timing t4, the positive data has been written once and the negative data has not been written at the pre-change rate (60 Hz). Therefore, an output from the counter 26 indicates "odd number."

Based on the output, the change control section 24 determines that there is a difference between the number of times the positive data has been written and the number of times the negative data has been written. Therefore, the change control section 24 controls the refresh rate changing section 22 to delay, by as long as one frame, the timing with which to change the refresh rate so that the refresh rate will be changed at a timing (timing t5) with which there is a match between the number of times the positive data has been written and the number of times the negative data has been written. Accordingly, the refresh rate changing section 22 changes a refresh rate during an eleventh frame and subsequent frames (after the timing t5) to 60 Hz.

Note that, according to the display device 1 of the present embodiment, the refresh rate of the display panel 2 is lowered by providing a pausing period(s) during which the display panel 2 is not driven. For example, in a case where the refresh rate of the display panel 2 is to be changed from 60 Hz to 30 Hz as shown in FIG. 4, the refresh rate is changed to 30 Hz by alternately providing (i) scanning periods each lasting a 1/60 second and (ii) pausing periods each lasting a 1/60 second.

According to the display device 1 of the present embodiment, it is possible to change the refresh rate of the display panel 2 to 1 Hz by alternately providing (i) scanning periods each lasting a 1/60 second and (ii) pausing periods each lasting a 59/60 second. Alternatively, according to the display device 1 of the present embodiment, it is possible to change the refresh rate to any rate.

The display device 1 of the present embodiment is thus configured to lower the refresh rate by providing a pausing period(s). This allows a reduction in refresh rate with lower electric power consumption, compared with a case where the refresh rate is reduced without providing any pausing periods.

In particular, the display device 1 of the present embodiment employs, in each pixel, a TFT made of an oxide semiconductor which has excellent off-state characteristics (described later). This makes it possible to maintain, for an extended period of time including a pausing period(s), a state in which image data is written into each pixel. Therefore, it is possible to maintain high display quality even in a case where the refresh rate is reduced by employing such a method described above.

As is described above, according to the display device 1 of the present embodiment, image data written into each pixel during a scanning period is retained in said each pixel during a pausing period by which the scanning period is immediately followed. Therefore, according to the display device 1 of the present embodiment, (i) a "period during which a positive source signal is written" means a period including both of (a) a scanning period during which the positive data is written and (b) a pausing period by which the scanning period is immediately followed and (ii) a "period during which a negative source signal is written" means a period including both of (a) a scanning period during which the negative data is written and (b) a pausing period by which the scanning period is immediately followed.

Note that the method by which to lower the refresh rate is not limited to the method described above, but it is possible to lower the refresh rate by adjusting the length of a scanning period. For example, in a case where the refresh rate of the display panel 2 is to be changed from 60 Hz to 30 Hz, it is possible to do so by consecutively providing scanning periods each lasting a 2/60 second.

According to the display device 1 of the present embodiment, in a case where no pausing periods is thus provided, (i) a "period during which a positive source signal is written" means a scanning period during which the positive data is written and (ii) a "period during which a negative source signal is written" means a scanning period during which the negative data is written.

(Another Example of Changing Refresh Rate)

Figure 5:
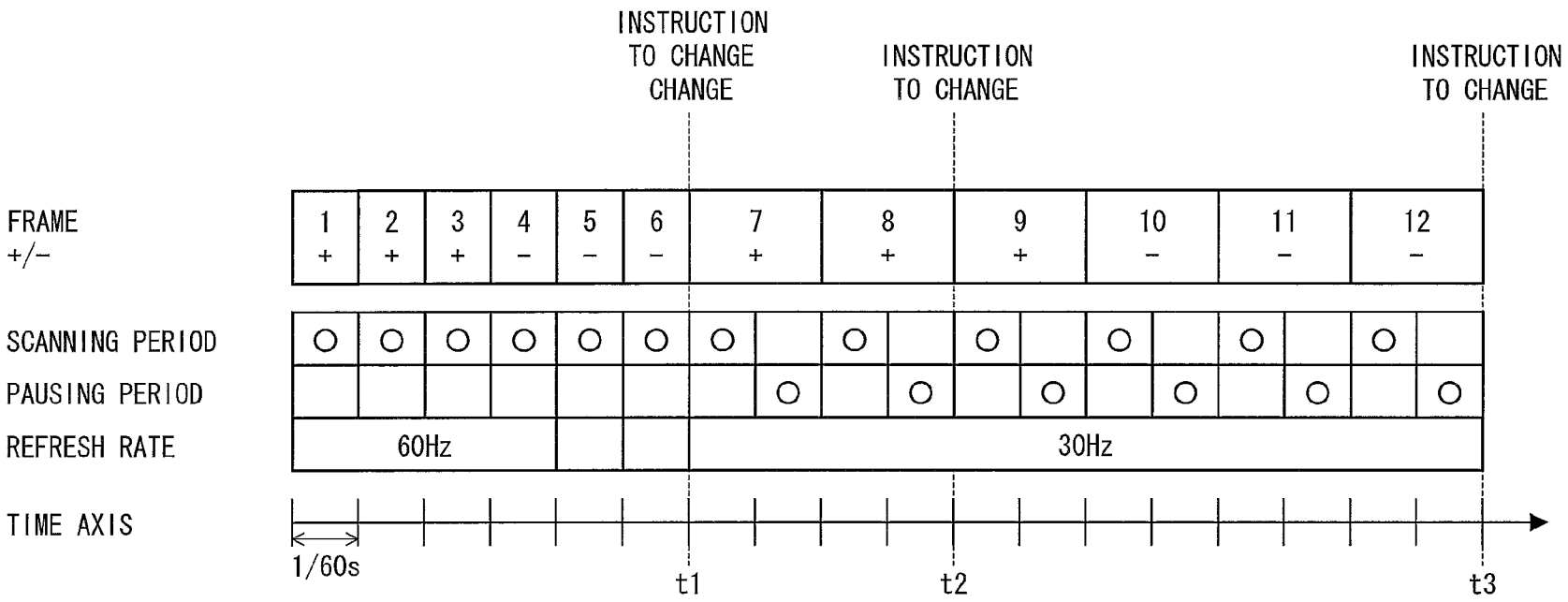
FIG. 5 is a view schematically illustrating another example in which the display device of the embodiment changes a refresh rate.

Another example of how the display device 1 of the present embodiment changes the refresh rate will be described next with reference to FIG. 5. FIG. 5 is a view schematically showing the example of how the display device 1 changes the refresh rate.

The example shown in FIG. 5 differs from the example shown in FIG. 4 in that the display device 1 employs a "three-frame" cycle as a time-based cycle of the polarity inversion in the example of FIG. 5. Therefore, in the example of FIG. 5, a polarity of a target pixel alternates with every three frames as in a pattern of "+, +, +, −, −, −, +, +, + . . . "

As illustrated in FIG. 5, in a case where (i) the display device 1 employs N-frame inversion driving and (ii) there is a difference, with a timing with which the display device 1 receives an instruction to change a refresh rate, between the number of times positive data has been written and the number of times negative data has been written, the change control section 24 controls the refresh rate changing section 22 to change the refresh rate with a timing with which the following conditions (1) and (2) are both met:

(1) There is a match between the number of times the positive data has been written and the number of times the negative data has been written. (2) The timing is after a number of frames ends, which number is a multiple of 2N.

In the example shown in FIG. 5, for example, the display device 1 receives, after an eighth frame ends (with a timing t2), an instruction to change the refresh rate to 60 Hz. At the timing t2, the positive data has been written twice and the negative data has not been written at a pre-change refresh rate (30 Hz).

In this case, the change control section 24 controls the refresh rate changing section 22 to delay the timing with which to change the refresh rate until a twelfth frame ends (i.e. the above conditions (1) and (2) are both met) so that the refresh rate will be changed with this timing (timing t3). Accordingly, the refresh rate changing section 22 changes a refresh rate during a thirteenth frame and subsequent frames (after the timing t3) to 60 Hz.

(Effects)

As has been described, the display device 1 of the present embodiment is configured such that in a case where the display device 1 receives an instruction to change a refresh rate, a timing with which to change the refresh rate is delayed so that the refresh rate is changed at a timing with which there is a match between the number of times positive data has been written and the number of times negative data has been written.

Because of such a configuration, the display device 1 of the present embodiment is capable of changing the refresh rate of the display panel 2 while there is no difference, in each of the pixels of the display panel 2, between (i) the length of time for which the positive data has been written and (ii) the length of time for which the negative data has been written. This prevents the occurrence of a malfunction such as image sticking on each pixel.

(Another Example of Changing Refresh Rate)

Figure 6:
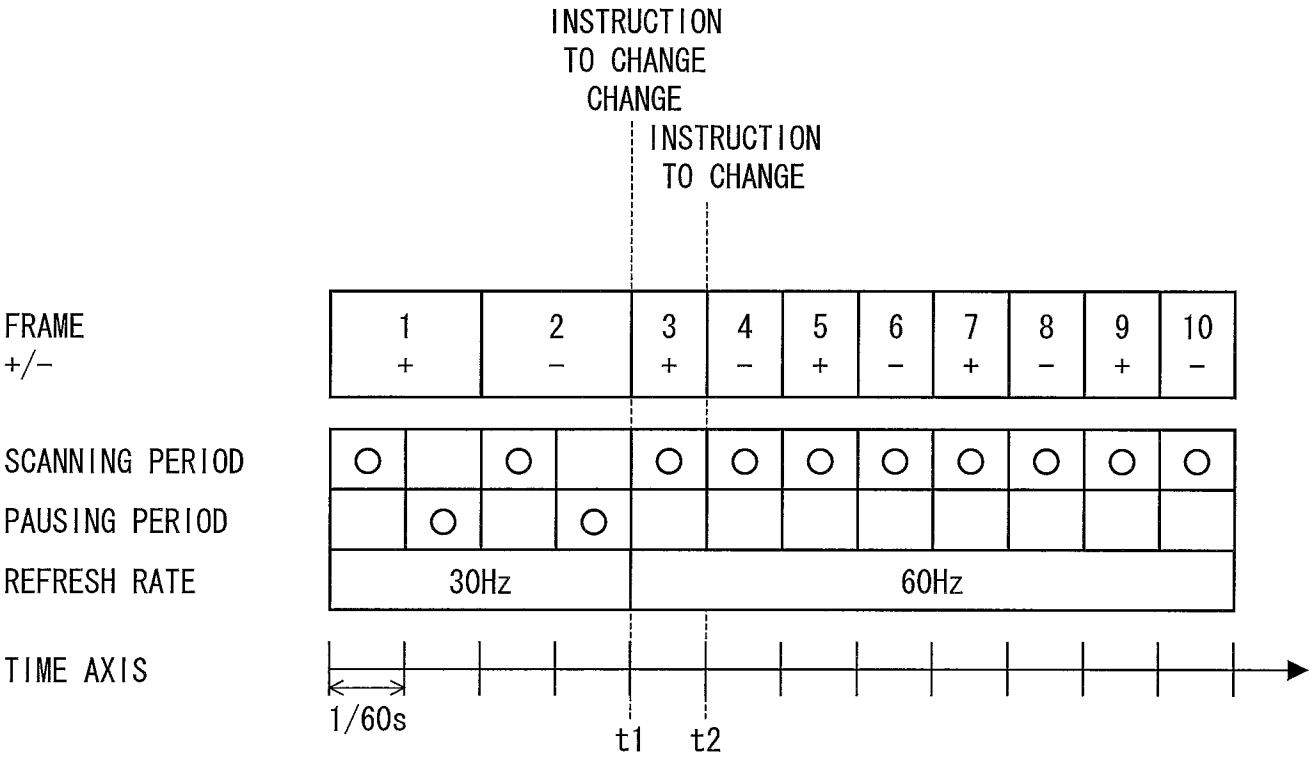
FIG. 6 is a view schematically illustrating a further example in which the display device of the embodiment changes a refresh rate.

A further example of how the display device 1 of the present embodiment changes the refresh rate will be described next with reference to FIG. 6. FIG. 6 is a view schematically showing the example of how the display device 1 changes the refresh rate.

The example shown in FIG. 6 is similar to the example shown in FIG. 4 in that the display device 1 employs a "one-frame" cycle as a time-based cycle of the polarity inversion. Therefore, in the example of FIG. 6, a polarity of a target pixel alternates with every three frames as in a pattern of "+, −, +, − . . . "

As illustrated in FIG. 6, in a case where an instruction to change a refresh rate is received during a second frame that immediately follows a first frame during which the refresh rate was changed, the change control section 24 controls the refresh rate changing section 22 not to change the refresh rate.

In the example shown in FIG. 6, for example, the display device 1 changes the refresh rate to 60 Hz after a second frame ends (with a timing t1). Then, after a third frame ends (with a timing t2), the display device 1 receives an instruction to change the refresh rate.

In this case, the change control section 24 controls the refresh rate changing section 22 not to change the refresh rate. Accordingly, the refresh rate changing section 22 does not change the refresh rate.

In this example also, the display device 1 is capable of changing the refresh rate of the display panel 2 while there is no difference, in each of the pixels of the display panel 2, between (i) the length of time for which positive data has been written and (ii) the length of time for which negative data has been written. This prevents the occurrence of a malfunction such as image sticking on each pixel.

(Pixels of Display Panel 2)

The pixels of the display panel 2 included in the display device 1 of the present embodiment will be described next.

The display device 1 of the present embodiment employs, as a TFT in each of the pixels of the display panel 2, a TFT made of an oxide semiconductor, in particular a TFT made of so-called IGZO (InGaZnOx), which is composed of indium (In), gallium (Ga), and zinc (Zn). The following description will discuss the advantage of a TFT made of an oxide semiconductor.

(TFT Characteristics)

Figure 7:
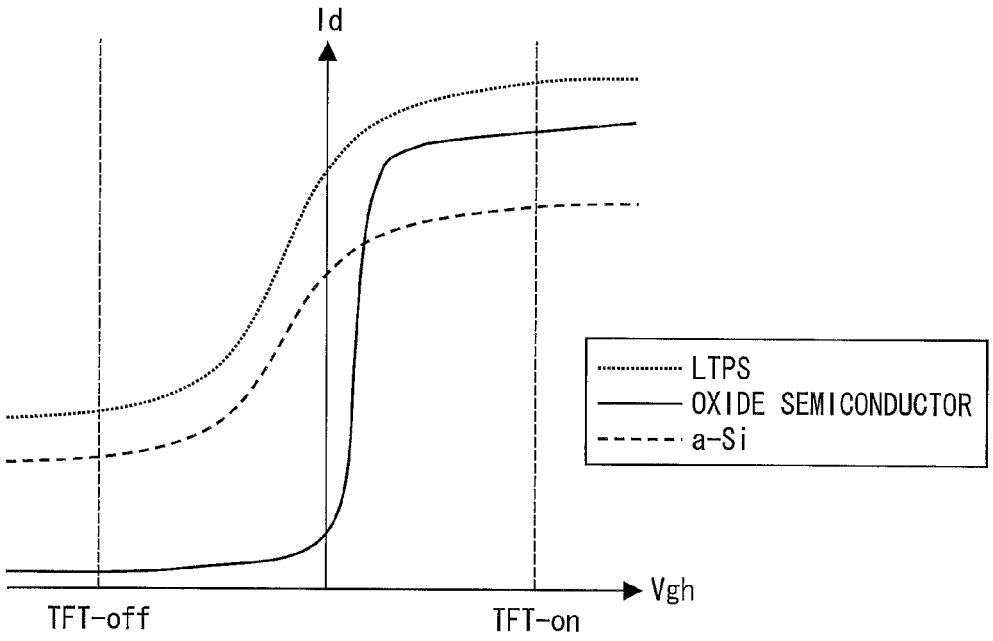
FIG. 7 is a diagram showing the characteristics of various types of TFT, including a TFT made of an oxide semiconductor.
Figure 8:
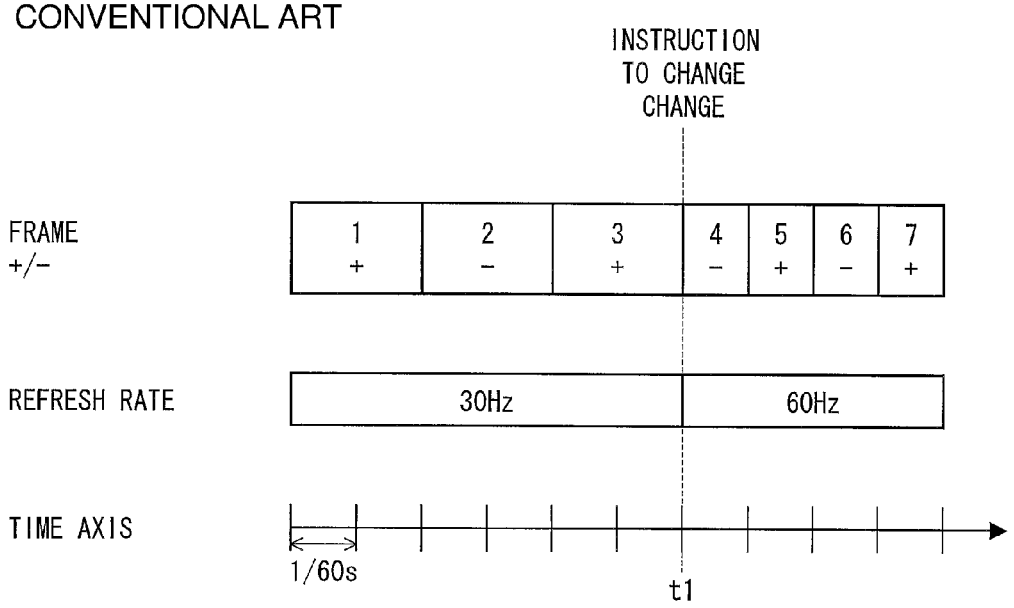
FIG. 8 CONVENTIONAL ART
FIG. 8 is a view schematically illustrating an example in which a conventional display device changes a refresh rate.

FIG. 7 is a diagram showing the characteristics of various types of TFT, including a TFT made of an oxide semiconductor. FIG. 7 shows the respective characteristics of TFTs made of an oxide semiconductor, a TFT made of a-Si (amorphous silicon), and a TFT made of LTPS (low-temperature polysilicon).

In FIG. 7, the horizontal axis (Vgh) represents the voltage value of on-voltage that is supplied to the gate in each of the TFTs, and the vertical axis (Id) the amount of an electric current between the source and the drain in each of the TFTs.

In particular, (i) a period indicated as "TFT-on" in FIG. 7 represents a period during which each TFT is turned on in response to the voltage value of an on-voltage and (ii) a period indicated as "TFT-off" in FIG. 7 represents a period during which each TFT is turned off in response to the voltage value of an off-voltage.

As shown in FIG. 7, a TFT made of an oxide semiconductor is higher in electron mobility in an on state than a TFT made of a-Si.

Specifically, although not illustrated, whereas the TFT made of a-Si has an Id current of 1 uA during the period TFT-on, the TFT made of an oxide semiconductor has an Id current of about 20 uA to 50 uA during the period TFT-on.

This shows that the TFT made of an oxide semiconductor is about 20 to 50 times higher in electron mobility in an on state than the TFT made of a-Si and is therefore vastly superior in on-state characteristics.

As described earlier, the display device 1 of the present embodiment employs such a TFT made of an oxide semiconductor in each of the pixels. This causes the on-state characteristic of each of the TFTs in the display device 1 to be superior. It is therefore possible to drive pixels with the use of smaller TFTs. This allows the TFTs to take up a smaller percentage of surface area of the respective pixels. In other words, it is possible to increase an aperture ratio of each pixel so as to increase transmissivity of light from a backlight. As a result, it is possible to employ a low-power-consumption backlight and/or suppress brightness of the backlight. This allows a reduction in power consumption.

Furthermore, since the off-state characteristic of each of the TFTs is superior, it is possible to reduce an amount of time required for writing a source signal into each of the pixels. This allows an increase in refresh rate of the display panel 2.

Further, as shown in FIG. 7, the TFT made of an oxide semiconductor is lower in leak current in an off state than the TFT made of a-Si.

Specifically, although not illustrated, whereas the TFT made of a-Si has an Id current of 10 pA during the period TFT-off, the TFT made of an oxide semiconductor has an Id current of about 0.1 pA during the period TFT-off.

This shows that the TFT made of an oxide semiconductor is about 1/100 as high in electron mobility in an off state as the TFT made of a-Si and is therefore vastly superior in off-state characteristics, with a leak current hardly occurring.

Hence, according to the display device 1 of the present embodiment, the off-state characteristics of the TFTs are superior, and it is therefore possible to maintain, for an extended period of time, a state in which a source signal is being written into each of the pixels of the display panel. This makes it possible to easily reduce the refresh rate of the display panel 2 while maintaining high display quality.

(Specific Examples of Determining Methods According to Various Conditions)

For the display device 1, various types of counter 26 can be used. In addition, the display device 1 can employ various polarity inversion cycles. The display device 1 may be configured such that scanning periods of single frames are provided, or that scanning periods in sets of n frames are provided. In addition, the display device 1 may be configured such that no pausing period is provided, that pausing periods of single frames are provided, or that pausing periods in sets of n frames are provided. These various conditions each affect a method of determining whether or not there is a match between (i) the length of time for which positive data is written and (ii) the length of time for which negative data is written.

Hence, the display device 1 preferably employs a determining method according to each of the various conditions. Specific examples of the determining method according to each of the conditions will be described below with reference to FIG. 9. FIG. 9 shows specific examples in which the display device 1 employs respective determining methods according to the various conditions. The various conditions and the respective determining methods in (a) through (d) of FIG. 9 are as follows:

(a) of FIG. 9: Case 1

Scanning periods: are of single frames

Pausing periods: are in sets of three frames

Polarity inversion: occurs with every scanning period (no polarity inversion during pausing periods)

Counter 26: is capable of counting the number of scanning periods (i.e. number of data writings) and outputting the counted number as indicative of "even number" or "odd number"

Determining method: if the output of the counter 26 indicates "even number", it is then determined that there is a match between the length of time for which positive data has been written and the length of time for which negative data has been written.

In the example shown in FIG. 9, for example, the output of the counter 26 indicates "even number" at a ninth frame. This causes the display device 1 to determine that, at the ninth frame, there is a match between the length of time for which the positive data has been written and the length of time for which the negative data has been written (indicated as "OK" in (a) of FIG. 9).

In the example of (a) of FIG. 9, before the ninth frame, the number of frames during which the positive data has been written is 4, and the number of frames during which the negative data has been written is 4 as well. Therefore, the determined result is correct.

(b) of FIG. 9: Case 2

Scanning period: are in sets of three frames

Pausing period: are in sets of three frames

Polarity inversion: occurs with every scanning period (no polarity inversion during pausing periods)

Counter 26: is capable of tracking the balance of polarities. Specifically, the counter 26 is capable of (i) adding 1 each time the number of frames during which positive data is written increases by 1 and (ii) subtracting 1 each time the number of frames during which negative data is written increases by 1.

Determining method: if the output of the counter 26 indicates "±0", it is then determined that there is a match between the length of time for which positive data has been written and the length of time for which negative data has been written.

In the example of (b) of FIG. 9, for example, an output of the counter 26 indicates "±0" at a twelfth frame. This causes the display device 1 to determine that, at the twelfth frame, there is a match between the length of time for which positive data has been written and the length of time for which negative data has been written (indicated as "OK" in (b) of FIG. 9).

In the example of (b) of FIG. 9, positive data is written during a first frame, negative data is written during a second frame, and positive data is written during a third frame whereas fourth through sixth frames are pausing periods. This causes the positive data to be retained during the fourth through sixth frames. Then, negative data is written during a seventh frame, positive data is written during an eighth frame, and negative data is written during a ninth frame whereas tenth through twelfth frames are pausing periods. This causes the negative data to be retained during the tenth through twelfth frames.

In other words, at the twelfth frame, the number of frames during which the positive data has been written is 6, and the number of frames during which the negative data has been written is 6 as well. Therefore, the determined result is correct.

(c) of FIG. 9: Case 3

Scanning period: are of single frames

Pausing period: are in sets of four frames

Polarity inversion: occurs with every frame (polarity inversion also occurs during pausing periods)

Counter 26: is capable of tracking the balance of polarities as is in Case 3

Determining method: if the output of the counter 26 indicates "±0", it is then determined that there is a match between the length of time for which positive data has been written and the length of time for which negative data has been written.

In the example of (c) of FIG. 9, for example, an output of the counter 26 indicates "±0" at a tenth frame. This causes the display device 1 to determine that, at the tenth frame, there is a match between the length of time for which positive data has been written and the length of time for which negative data has been written (indicated as "OK" in (c) of FIG. 9).

In the example of (c) of FIG. 9, positive data is written during a first frame while second through fourth frames are pausing periods. This causes the positive data to be retained during the second through fourth frames. Although the polarity is inverted between the second through fourth frames in (c) of FIG. 9, what is shown is a polarity of a source output amplifier. In fact, it is not that data having such polarities is written during the second through fourth frames, but that positive data written during the first frame is retained.

Then, negative data is written during a sixth frame while seventh through tenth frames are pausing periods. This causes negative data to be retained during the seventh through tenth frames. Although the polarity is inverted between the seventh through tenth frames in (c) of FIG. 9, what is shown is a polarity of the source output amplifier. In fact, it is not that data having such polarities is written during the seventh through tenth frames, but that negative data written during the sixth frame is retained.

In other words, at the tenth frame, the number of frames during which the positive data has been written is 5, and the number of frames during which the negative data has been written is 5 as well. Therefore, the determined result is correct.

(d) of FIG. 9: Case 4

Scanning period: are in sets of three frames

Pausing period: are in sets of four frames

Polarity inversion: occurs with every frame (polarity inversion also occurs during pausing periods)

Counter 26: is capable of tracking the balance of polarities

Determining method: if the output of the counter 26 is "±0", it is determined that there is a match between the length of time for which the positive data has been written and the length of time for which the negative data has been written.

In the example shown in (d) of FIG. 9, for example, an output of the counter 26 indicates "±0" at a fourteenth frame. This causes the display device 1 to determined that, at the fourteenth frame, there is a match between the length of time for which the positive data has been written and the length of time for which the negative data has been written (indicated as "OK" in (d) of FIG. 9).

In the example of (d) of FIG. 9, positive data is written during a first frame, negative data is written during a second frame, and positive data is written during a third frame while fourth through seventh frames are pausing periods. This causes positive data to be retained during the fourth through seventh frames. Although the polarity is inverted between the fourth through seventh frames in (d) of FIG. 9, what is shown is a polarity of the source output amplifier. In fact, it is not that data having such polarities is written during the fourth through seventh frames, but that positive data written during the third frame is retained.

Then, negative data is written during an eighth frame, positive data is written during a ninth frame, and negative data is written during a tenth frame while eleventh through fourteenth frames are pausing periods. This causes negative data to be retained during the eleventh through fourteenth frames. Although the polarity is inverted between the eleventh through fourteenth frames in (d) of FIG. 9, what is shown is a polarity of the source output amplifier. In fact, it is not that data having such polarities is written during the eleventh through fourteenth frames, but that negative data written during the tenth frame is retained.

In other words, at the fourteenth frame, the number of frames during which the positive data has been written is 7, and the number of frames during which the negative data has been written is 7 as well. Therefore, the determined result is correct.

(Supplementary Explanation)

The present invention is not limited to the description of the embodiments, but can be altered in many ways by a person skilled in the art within the scope of the claims. An embodiment derived from a proper combination of technical means disclosed in different embodiments is also encompassed in the technical scope of the present invention.

For example, setting values such as refresh rates, time-based cycles of polarity inversion of source signals, and space-based cycles of polarity inversion of source signals are illustrative only. Needless to say, these setting values may be changed to any proper values, depending on characteristics and/or use of a display device.

The embodiment discussed the example of applying, to the present invention, a display device in which TFTs each made of an oxide semiconductor (particularly IGZO) is used for the pixels. However, the present invention is not limited to such an example. In fact, it is also possible to apply, to the present invention, display devices in which other TFTs such as those made of a-Si or LTPS are used for pixels.

According to the embodiment, the use is made of, as a counter 26 included in the timing controller 12, an odd/even counter that produces an output indicative of whether the sum of the number of times positive data is written and the number of times negative data is written is an even number or an odd number. As an alternative, it is also possible to use a counter that produces an output indicative of the sum itself. As an alternative, it is also possible to use a counter that produces (i) an output indicative of the number of times positive data is written and (ii) an output indicative of the number of times negative data is written. As an alternative, it is possible to use a counter that produces (i) an output indicative of the number of frames during which positive data is written and (ii) an output indicative of the number of frames during which negative data is written. In any of the cases above, the change control section 24 can easily determine whether or not there is a balance between the length of time for which positive data is written and the length of time for which negative data is written.

Note that the display device of the embodiment can be configured in any way, provided that the display device is at least configured such that a refresh rate is changed with a timing with which there is a balance between (i) the length of time for which positive data is written and (ii) the length of time for which negative data is written.

For example, the display device of the embodiment can be configured such that (i) the number of times positive data is written and the number of times negative data is written are each counted and (ii) a refresh rate is changed with a timing with which (a) the respective numbers are equal or (b) a difference between the respective numbers is smaller than a predetermined threshold.

As an alternative, the display device of the embodiment can be configured such that (i) the number of frames during which positive data is written and the number of frames during which negative data is written are each counted and (ii) a refresh rate is changed with a timing with which (a) the respective numbers are equal or (b) a difference between the respective numbers is smaller than a predetermined threshold.

As an alternative, the display device of the embodiment can be configured such that (i) the length of time for which positive data is written and the length of time for which negative data is written are each measured and (ii) a refresh rate is changed with a timing with which (a) the respective numbers are equal or (b) a difference between the respective numbers is smaller than a predetermined threshold.

In any of the cases above, the display device of the embodiment is capable of changing a refresh rate of the display panel with timings with which a display malfunction such as image sticking on each pixel is unlikely to occur.

[Summary]

As has been described, a drive device in accordance with an embodiment of the present invention is a drive device for driving a display panel, said display panel including: pixels, said drive device comprising: refresh rate changing means for changing, in a case where (i) positive source signals and negative source signals are being written into at least one pixel of the display panel such that the positive source signals and the negative source signals are alternated with every frame or with every given number of frames and (ii) an instruction to change a refresh rate of the display panel is received, the refresh rate with a timing with which there is a balance between a length of time for which the positive source signals are written into the at least one pixel and a length of time for which the negative source signals are written into the at least one pixel.

In the description of the configuration, the word "balance" refers to a state in which the respective lengths are equal. However, the word "balance" is not limited to such a definition, but applies to a case where there is a difference between the respective lengths, provided that the difference is not so large as to cause, for example, a display malfunction such as image sticking. Therefore, with the drive device, it is possible to change the refresh rate of the display panel with timings with which a display malfunction such as image sticking in each pixel is unlikely to occur.

Note that (i) the configuration is relative to such an inversion driving mode that "positive source signals and negative source signals are being written into at least one pixel of the display panel such that the positive source signals and the negative source signals are alternated with every frame or with every given number of frames" and (ii) examples of such an inversion driving mode encompass various inversion driving modes such as a dot inversion driving mode, a source inversion driving mode, and a frame inversion driving mode.

The drive device is preferably configured such that the refresh rate changing means changes the refresh rate with a timing with which a difference between the length of time for which the positive source signals are written into the at least one pixel and the length of time for which the negative source signals are written into the at least one pixel is shorter than a predetermined length of time.

With the configuration, it is possible to easily determine whether or not to change a refresh rate by a simple comparison between (i) the length of time for which the positive source signals are written and (ii) the length of time for which the negative source signals are written.

In the description of the configuration, the "predetermined length of time" refers to, for example, an allowable range of difference between the length of time for which the positive data is written and the length of time for which the negative data is written, the difference being not so large as to cause a display malfunction such as image sticking.

The drive device is preferably configured such that the refresh rate changing means changes the refresh rate with a timing with which there is a match between the length of time for which the positive source signals are written into the at least one pixel and the length of time for which the negative source signals are written into the at least one pixel.

With the configuration, it is possible to change the refresh rate with timings with which there is a match between the length of time for which the positive data is written and the length of time for which the negative data is written, that is, timings with which a display malfunction such as image sticking does not occur.

The drive device is preferably configured such that, in a case where (i) the positive source signals and the negative source signals are written so as to be alternated with every frame and (ii) the instruction to change the refresh rate is received, the refresh rate changing means changes the refresh rate with a timing with which a sum of the number of times the positive source signals are written and the number of times the negative source signals are written is an even number.

With the configuration, it is possible to easily determine whether or not to change the refresh rate by, without complex computation or the like, merely determining whether or not the sum is an even number.

The drive device is preferably configured such that, in the case where the instruction to change the refresh rate is received, the refresh rate changing means changes the refresh rate with a timing with which there is a match between (i) a sum of (a) the number of frames during which the positive source signals are written and (b) the number of frames during which the positive source signals are retained and (ii) a sum of (a) the number of frames during which the negative source signals are written and (b) the number of frames during which the negative source signals are retained.

With the configuration, it is possible, even in a case where source signals are not written during certain frames such as pausing periods, to properly determine whether or not there is a match between (i) the length of time for which the positive source signals are written and (ii) the length of time for which the negative source signals are written.

The drive device is preferably configured such that, in a case where (i) the positive source signals and the negative source signals are written so as to be alternated with every frame, (ii) the instruction to change the refresh rate is received, and (iii) there is a difference between the number of frames during which the positive source signals are written and the number of frames during which the negative source signals are written, the refresh rate changing means delays, by one frame, a timing with which to change the refresh rate.

With the configuration, it is possible, without complex computation or the like, to easily match the length of time for which the positive data is written to the length of time for which the negative data is written by merely delaying the timing of change the refresh rate by one frame.

The drive device is preferably configured such that, in a case where (i) the positive source signals and the negative source signals are written so as to be alternated with every N frames, (ii) the instruction to change the refresh rate is received, and (iii) there is a difference between the number of frames during which the positive source signals are written and the number of frames during which the negative source signals are written, the refresh rate changing means delays, by a number of frames which number is a multiple of 2N, a timing with which to change the refresh rate.

With the configuration, it is possible to easily determine, without complex computation, timings with which to change a refresh rate.

The drive device is preferably configured such that, in a case where the instruction to change the refresh rate is received during a second frame immediately following a first frame during which the refresh rate changing means changed the refresh rate, the refresh rate changing means does not change the refresh rate in response to the instruction.

With the configuration also, it is possible to prevent a difference between (i) the length of time for which the positive data is written and (ii) the length of time for which the negative data is written.

The drive device is preferably configured such that the refresh rate changing means reduces the refresh rate by providing a pausing period during which driving of the display panel is paused.

With the configuration, it is possible to cause electric power consumption to be lower than it would be in a case where the refresh rate is reduced without providing any pausing periods.

A display device in accordance with an embodiment of the present invention includes a display panel including pixels; and one of the drive devices above.

With the configuration, it is possible to provide a display that brings about advantageous effects that are brought about by the drive device.

The display device is preferably configured such that a semiconductor layer of each of TFTs of the respective pixels is made of an oxide semiconductor. The display device is preferably configured such that the oxide semiconductor is IGZO.

According to the configurations, on-state characteristics and off-state characteristics of each pixel becomes excellent. This allows a refresh rate to be easily increased/decreased. Hence, there easily occurs a difference between the length of time for which positive source signals are written and the length of time for which negative source signals are written, and therefore a necessity for eliminating such a difference becomes more urgent. Hence, the advantageous effects of the present invention becomes more significant by applying the present invention to such a display device.

INDUSTRIAL APPLICABILITY

A display device in accordance with an embodiment of the present invention can be used as various display devices such as liquid crystal display devices, organic EL display devices, and electronic papers. In particular, the display device in accordance with the embodiment of the present invention can be suitably used as various active matrix display devices.

REFERENCE SIGNS LIST

1 Display device
2 Display panel
10 Display drive circuit (drive device)
12 Timing controller
14 Scanning line drive circuit
16 Signal line drive circuit
18 Common electrode drive circuit
20 Polarity inversion control section
22 Refresh rate changing section
24 Change control section (frame frequency switching controlling means)
26 Counter
28 Power generating circuit
30 System-end control section

The invention claimed is:

1. A drive device for driving a display panel,
the display panel comprising:
a plurality of pixels,
wherein, in a case where (i) positive source signals and negative source signals are being written into at least one pixel of the display panel such that the positive source signals and the negative source signals are alternated with every frame or with every given number of frames and (ii) an instruction to change a refresh rate of the display panel is received, the drive device changes the refresh rate with a timing with which there is a match between a length of time for which the positive source signals are written into the at least one pixel and a length of time for which the negative source signals are written into the at least one pixel, and
wherein, in a case where the instruction to change the refresh rate is received during a second frame immediately following a first frame during which the drive device changes the refresh rate, the drive device does not change the refresh rate in response to the instruction.

2. The drive device as set forth in claim 1, wherein, in a case where (i) the positive source signals and the negative source signals are written so as to be alternated with every frame and (ii) the instruction to change the refresh rate is received, the drive device changes the refresh rate with a timing with which a sum of the number of times the positive source signals are written and the number of times the negative source signals are written is an even number.

3. The drive device as set forth in claim 1, wherein, in the case where the instruction to change the refresh rate is received, the drive device changes the refresh rate with a timing with which there is a match between (i) a sum of (a) the number of frames during which the positive source signals are written and (b) the number of frames during which the positive source signals are retained and (ii) a sum of (a) the number of frames during which the negative source signals are written and (b) the number of frames during which the negative source signals are retained.

4. The drive device as set forth in claim 1, wherein, in a case where (i) the positive source signals and the negative source signals are written so as to be alternated with every frame, (ii) the instruction to change the refresh rate is received, and (iii) there is a difference between the number of frames during which the positive source signals are written and the number of frames during which the negative source signals are written, the drive device delays, by one frame, a timing with which to change the refresh rate.

5. The drive device as set forth in claim 1, wherein, in a case where (i) the positive source signals and the negative source signals are written so as to be alternated with every N frames and N is an integer greater than one, (ii) the instruction to change the refresh rate is received, and (iii) there is a difference between the number of frames during which the positive source signals are written and the number of frames during which the negative source signals are written, the drive device delays, by a number of frames which number is a multiple of 2N, a timing with which to change the refresh rate.

6. The drive device as set forth in claim 1, wherein the drive device reduces the refresh rate by providing a pausing period during which driving of the display panel is paused.

7. A display device comprising:
the drive device as set forth in claim 1.

8. The display device as set forth in claim 7, wherein a semiconductor layer of each of TFTs (Thin Film Transistors) of the respective pixels is made of an oxide semiconductor.

9. The display device as set forth in claim 8, wherein the oxide semiconductor is IGZO (InGaZnOx).

* * * * *